US006208309B1

(12) United States Patent
Chandler et al.

(10) Patent No.: US 6,208,309 B1
(45) Date of Patent: Mar. 27, 2001

(54) DUAL DEPTH APERTURE CHOKES FOR DUAL FREQUENCY HORN EQUALIZING E AND H-PLANE PATTERNS

(75) Inventors: Charles W. Chandler, San Gabriel; Makkalon Em, Venice, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/270,960

(22) Filed: Mar. 16, 1999

(51) Int. Cl.[7] ..... H01Q 13/00

(52) U.S. Cl. ..... 343/786; 343/772; 343/775; 343/781 R

(58) Field of Search ..... 343/786, 772, 343/775, 781 R; H01Q 13/00

(56) References Cited

U.S. PATENT DOCUMENTS

| | | | | |
|---|---|---|---|---|
| 3,631,502 | | 12/1971 | Peters, Jr. et al. | 343/786 |
| 3,924,237 | | 12/1975 | Fletcher et al. | 343/786 |
| 3,938,159 | | 2/1976 | Ajioka et al. | 343/756 |
| 4,168,504 | | 9/1979 | Davis | 343/786 |
| 4,442,437 | | 4/1984 | Chu et al. | 343/786 |
| 4,477,816 | | 10/1984 | Cho | 343/786 |
| 4,658,258 | * | 4/1987 | Cook | 343/786 |
| 4,680,558 | * | 7/1987 | Ghosh et al. | 333/21 R |
| 4,785,306 | | 11/1988 | Adams | 343/786 |
| 4,847,574 | | 7/1989 | Gauthier et al. | 333/135 |
| 5,003,321 | | 3/1991 | Smith et al. | 343/781 R |
| 5,258,768 | | 11/1993 | Smith | 343/786 |
| 5,486,839 | | 1/1996 | Rodeffer et al. | 343/786 |
| 5,546,097 | | 8/1996 | Ramanujam et al. | 343/781 R |
| 5,552,797 | * | 9/1996 | Cook | 343/786 |
| 5,812,096 | | 9/1998 | Tilford | 343/781 R |

FOREIGN PATENT DOCUMENTS

144319 * 11/1981 (DE) ..... H01Q/13/02

* cited by examiner

*Primary Examiner*—Don Wong
*Assistant Examiner*—Hoang Nguyen
(74) *Attorney, Agent, or Firm*—Michael S. Yatsko

(57) ABSTRACT

A horn antenna is provided which is capable of operating at a plurality of separate frequencies while providing substantially equalized E and H-plane patterns for each of the separate frequencies. The antenna includes a coupling portion to permit coupling to a communication device. An inner portion is coupled to the coupling portion, and includes a first choke having a depth which extends substantially parallel to a central longitudinal axis of the antenna and a width which extends in a radial direction of the antenna. The depth and the width of the first choke are set so that the first choke will operate at the first frequency. An outer portion is coupled to the inner portion, wherein the outer portion has a maximum diameter in the radial direction which is greater than the maximum diameter in the radial direction of the inner portion. The outer portion includes a second choke which also has a depth to extend substantially parallel to the central longitudinal axis of the antenna, and a width which extends in the radial direction. The depth and the width of the second choke are greater than the depth and the width of the first choke, and are set so that the second choke will operate at the second frequency. By virtue of the fact that the depths of the chokes extend in a direction substantially parallel to the longitudinal axis of the horn, the maximum electrical aperture of the antenna can be very close in size to the maximum physical diameter.

46 Claims, 4 Drawing Sheets

DUAL DEPTH APERTURE CHOKES FOR DUAL FREQUENCY HORN EQUALIZING E AND H-PLANE PATTERNS

BACKGROUND OF THE INVENTION

The present invention relates generally to horn antennas, and, more particularly, to horn antennas capable of operating at two or more separate frequencies and capable of providing equalized E and H plane patterns at each of the frequencies.

In the communication field, a number of systems exist which require antenna systems to be capable of operating at two or more separate frequencies. For example, in military and commercial satellite systems, it is common for the uplink signal from a ground station to the satellite to have a first frequency while the downlink signal from the satellite to the ground station has a second frequency. Commercial and military Ka-Band communication satellites are one example of this where the uplink frequency is 20 GHz and the downlink frequency is 30 GHz.

In the past, communication satellite systems such as those mentioned above have handled the two frequencies by using reflector antenna systems in the satellite which are designed with an antenna feed (for example, a feed horn) and a reflector system (generally using a primary reflector and a sub-reflector). In such an arrangement, separate horn antennas are often used as the feeds, with one horn antenna provided for each frequency to be covered. On the other hand, various systems have been developed using a single horn operating at dual frequencies. U.S. Pat. No. 3,938,159, U.S. Pat. No. 4,785,306 and U.S. Pat. No. 5,003,321 are three examples of such dual frequency feed horns that can be used in a satellite communication system. However, these arrangements are somewhat complicated to construct, and are not readily adaptable to equalizing the E and the H plane patterns at the different frequencies.

In their studies, the inventors considered the possibility of using a corrugated horn operating at two or more separate frequencies such as the above-noted 20 GHz and 30 GHz frequencies in the Ka-Band. Corrugated horns (i.e., horns where corrugated recesses are provided which each have a depth extending radially to the central axis of the horn) have an advantage in being able to readily provide antenna patterns that are equal in the E and H planes by effectively terminating substantially all of the current parallel to the inner wall of the horn (so that the horn will have the same boundary conditions that exist for the E field perpendicular to the wall). To this end, the inventors designed and studied a corrugated horn such as shown in FIG. 1.

In the arrangement shown in FIG. 1, a corrugated horn 10 has a plurality of corrugated recesses 12 that gradually increase in depth and width from an inner portion of the horn to an outer portion. By virtue of the different depths, the center frequency of each of the recesses 12 will be slightly different than that of the adjacent recess 12. Typically, the depth is set at $\lambda/4$ to tune to the desired frequency. The width of each corrugation recess 12 determines the bandwidth of that particular recess around the center frequency. Thus, by properly designing the depth and the width of each of the recesses 12, the horn of FIG. 1 can provide continuous coverage of a desired frequency band. Also, by properly setting the depth and width of the corrugation recesses, equalized E and H plane patterns can be provided within that frequency band, as noted above.

In further considering this structure, the inventors studied the possibility of providing two or more groups of corrugation recesses 12 in a horn such as FIG. 1, to thereby construct a horn which would operate at two distinct frequency bands (e.g., centered around 20 GHz and 30 GHz, for example), while providing equalized E and H plane patterns at each of these separate frequency bands. However, after considering this, the inventors noted a fundamental problem which would exist with such an arrangement. Specifically, as shown in FIG. 1, the electrical aperture of the corrugated horn 10 would be limited to the inner diameter of the horn. Because of the corrugation recess construction, this inner diameter will be substantially smaller than the actual maximum physical diameter of the horn. In other words, the corrugated horn 10 of FIG. 1 has a significantly larger physical aperture than its electrical aperture. This can be a serious drawback, particularly in terms of size and weight considerations which are involved in construction of a satellite antenna. Also, the relatively large physical diameter of such a horn could serve as a significant constraint in reflector systems used in satellites wherein a plurality of feed horns might be located adjacent to one another to provide multiple coverage beams from a single reflector system.

SUMMARY OF THE INVENTION

It is an object of the present invention to provide a horn capable of operating at two or more separate frequencies.

It is a further object of the present invention to provide a horn antenna capable of operating at two or more separate frequencies while providing substantially equalized E and H plane patterns at each of the different frequencies.

It is a further object of the present invention to provide an antenna horn capable of operating at two or more separate frequencies and providing substantially equalized E and H plane patterns, wherein the electrical aperture of the horn is close in size to the physical aperture.

It is a further object of the present invention to provide a horn antenna capable of operating at two or more frequencies which is easy to construct, compact in size and capable of providing equal E and H plane patterns at multiple separate frequencies.

To achieve this and other objects, a horn antenna is provided which is capable of operating at a plurality of separate frequencies, and which includes a coupling portion to permit coupling of the horn antenna to a communication device. An inner portion is coupled to the coupling portion, and includes a first choke having a depth which extends substantially parallel to a central longitudinal axis of the antenna and a width which extends in a radial direction of the antenna. The depth and the width of the first choke are set so that the first choke will operate at the first frequency. An outer portion is coupled to the inner portion, wherein the outer portion has a maximum diameter in the radial direction which is greater than the maximum diameter in the radial direction of the inner portion. The outer portion comprises a second choke which also has a depth to extend substantially parallel to the central longitudinal axis of the antenna, and a width which extends in the radial direction.

DETAILED DESCRIPTION OF THE INVENTION

Figure 2:
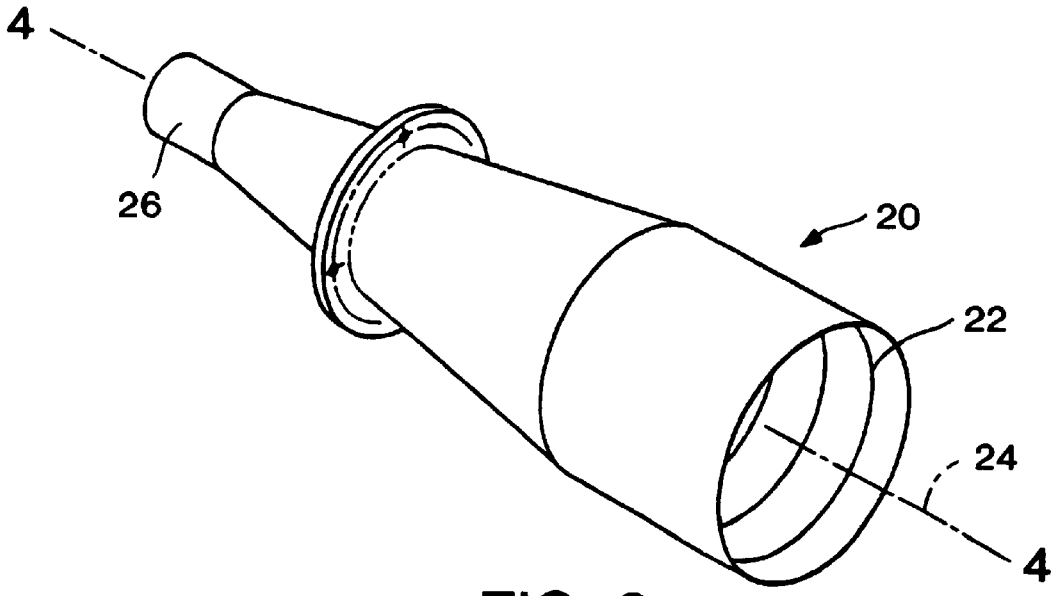
FIG. 2 shows a perspective view of a preferred embodiment of the horn constructed in accordance with the present invention.

FIG. 2 provides an overall perspective view of a horn 20 constructed in accordance with a preferred embodiment of the present invention. As will be described in detail below, the horn 20 of this embodiment is constructed as a conical horn having a plurality of chokes 22 arranged concentrically within the horn to have depths which extend substantially parallel to the longitudinal central axis 24 of the horn. The widths of these chokes 22 extend substantially radially, noting that the horn is preferably rotationally symmetrical about the longitudinal axis 24. The diameter of the horn gradually increases from a connecting portion 26 which permits connection to an input or an output element (for example, a circular waveguide) of a communication device (for example, a receiver and/or transmitter).

As will be discussed below in more detail, the chokes 22 are arranged to operate in separate frequency bands, wherein the higher frequency operation takes place in the chokes closest to the connecting portion 26, while the lowest frequency operation takes place in the chokes closest to the maximum aperture of the horn. Thus, for example, the horns can operate at two or more separate frequency bands centered around 20 GHz and 30 GHz if the system is used in a Ka-Band communication satellite system as discussed above.

With regard to the terminology used in the present description, it is noted that the term "separate frequencies" is intended to refer to two discrete frequencies which are separated from one another by a range of frequencies. In other words, this would include situations such as discussed above wherein the "separate frequencies" are 20 GHz and 30 GHz. Of course, some degree of bandwidth would be associated with each of the separate frequencies. As such, the term "separate frequencies" is intended to refer to situations where the bandwidths of the separate frequencies are not sufficiently large that the frequencies effectively blend into one another to form a continuous range of frequencies.

Similarly, the term "frequency band" is intended to refer to a discrete frequency, such as 20 GHz, and a predetermined bandwidth around this discrete frequency. For example, in the case of 20 GHz, the term "frequency band" could include 19.99 GHz to 20.01 GHz. In other words, with this definition, the frequencies 20 GHz and 30 GHz, with their respective bandwidths, are considered as two separate frequency bands, notwithstanding the fact that they are both within the overall Ka-Band. To put this another way, what is intended is to define two frequency ranges which are separate from one another by another range of frequencies (even though they might exist within an overall frequency band such as the Ka-Band), as opposed to covering a large range such as all of the frequencies between 20 GHz and 30 GHz.

Figure 3:
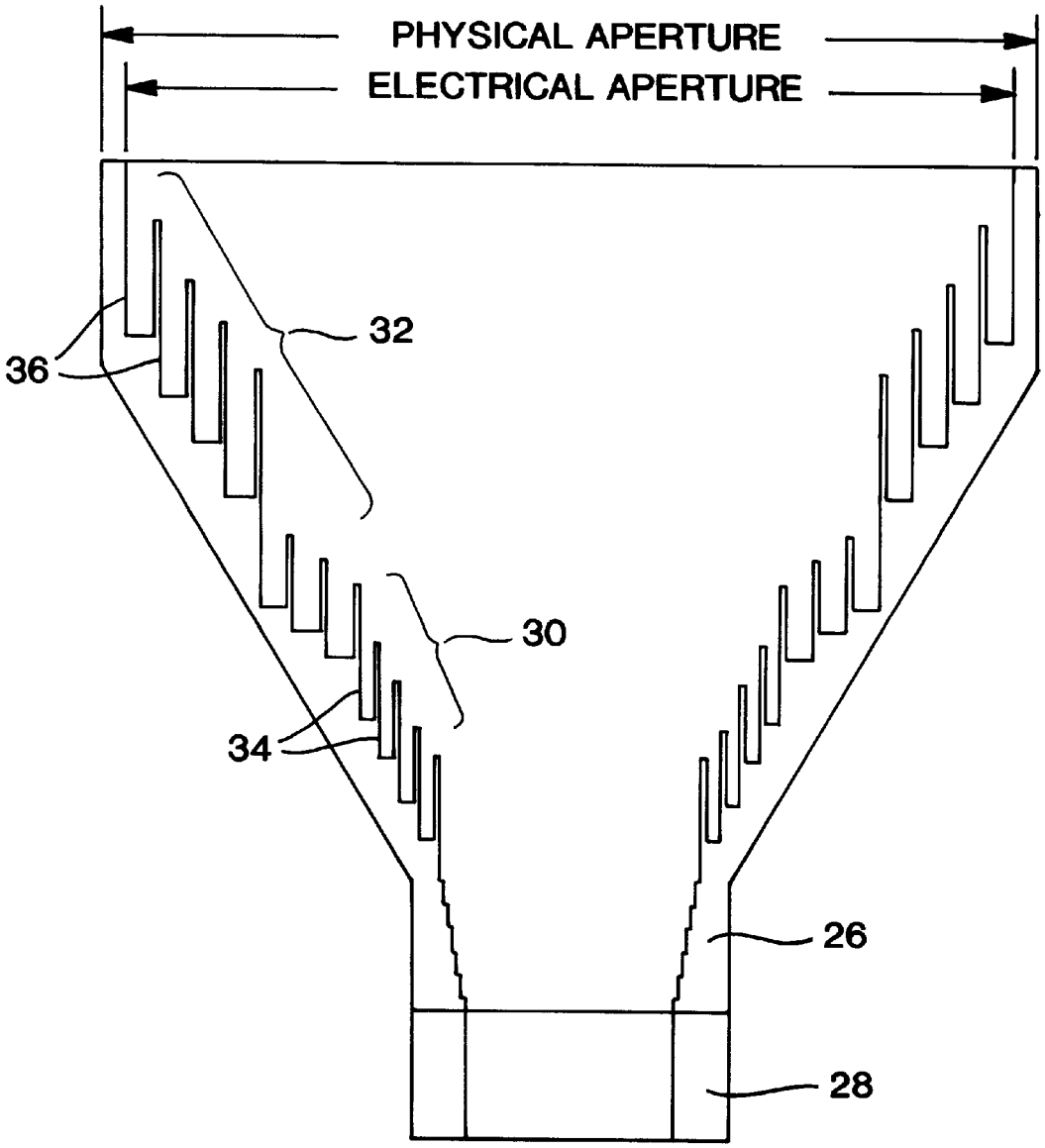
FIG. 3 is a simplified cross-section of a horn constructed in accordance with the present invention to operate at two separate frequencies.

FIG. 3 is a simplified illustration of the present invention which is provided to facilitate understanding of the principles involved in the present invention. In this figure, the depth and width dimensions are exaggerated for purposes of illustration. In FIG. 3, the connection portion 26 is constructed as a tapered transition coupled to a circular waveguide 28 which can operate as an exciting port. In the embodiment using 20 GHz and 30 GHz as the center frequencies, the circular waveguide 28 can be used both to receive the 20 GHz signal from the horn to provide these signals to a satellite receiver and to transmit the 30 GHz signal from the satellite transmitter to the horn to be transmitted as a downlink signal. On the other hand, if higher frequencies are involved, a coaxial feed, or some other feed mechanism, could be provided in conjunction with a waveguide. It is also noted that any type of connection would be used, and the invention is not limited to the illustrated tapered connection.

An inner portion 30 is coupled to the connection portion 26 to provide the high frequency component of the horn 20. An outer portion 32 is coupled to the inner portion 30 to provide the low frequency component of the horn 20. Between these two portions 30 and 32, the chokes 22 (see FIG. 1) are constructed to be broken down into a group of first chokes 34 and a group of second chokes 36. As can be seen in FIG. 3, the depth and width of the first chokes 34 are significantly smaller than the depths and widths of the second chokes 36 so that the inner portion 30 will operate at a higher frequency.

More specifically, the depths and widths of the first chokes gradually increase from the smallest one, immediately adjacent to the connection portion 26, to the largest one, immediately adjacent to the outer portion 32. In this way, a frequency band of operation is provided. For example, if the high frequency of 30 GHz is intended, a central one of the first chokes 34 can be constructed with a depth tuned to resonate at 30 GHz. Those first chokes 34 which are closer to the connection portion 26 can be tuned to have progressively higher center frequencies (by having smaller depths), while those first chokes 34 closer to the outer portion 32 can be tuned to have progressively lower center frequencies (by increasing the depth). The width of the first chokes 34 control the bandwidth of operation of each of the first chokes 34 around its particular center frequency. Thus, by adjusting the depths and widths suitably, a continuous frequency range of, say, 29.99 GHz to 30.01 GHz can be provided to ensure satisfactory operation at the 30 GHz frequency by allowing a slight bandwidth to account for minor variations in the downlink signal.

By way of example, this can be accomplished by using five of the first chokes 34 and setting the widths of the respective chokes to provide sufficient bandwidth around each of the center frequencies so that, as a whole, the five chokes will completely cover the frequencies between 29.99 GHz and 30.01 GHz. It should be noted that the depths of the chokes should be significantly greater than the widths in order to provide proper choke operation. Typically, the widths of the chokes can be set between $\lambda/10$ and $\lambda/20$, although the invention is not limited to this. Of course, the greater the width of the choke, the broader the bandwidth of the particular choke. With regard to spacing, the chokes should, in general, be spaced to avoid electrical interference between them. This will depend on the frequency and bandwidth of operation of each choke. Finally, the number of chokes used in either the inner or outer portions (or any internal portions, for that matter) determine the overall total bandwidth of that portion (with each choke covering a small band within the larger overall band).

In this same way, the depth and width of the second chokes 36 of the outer portion 32 can be varied to provide coverage of a frequency range of, say, 19.99 GHz to 20.01 GHz to ensure adequate reception of the 20 GHz uplink signal. With regard to this, it is noted that the present invention is intended to operate at two separate frequencies (or frequency bands), such as 20 GHz and 30 GHz which are substantially different from one another. It is noted, of course, that these frequencies are provided herein only for purposes of example, and that the present invention can operate at various frequencies as desired. For example, the present invention is also very well suited for operation at frequencies within the X-Ku-Band. It is further noted that the horn has been described as a dual frequency horn solely for purposes of convenience, and it could readily be constructed to operate at three or more separate frequencies by adding a middle section between the inner portion 30 and the outer portion 32, with chokes of the one or more middle sections being tuned to intermediate frequencies. Also, although the above description sets forth an arrangement for receiving one frequency and transmitting another frequency, the present invention can be used for receive-only systems or transmit-only systems using two or more frequencies as well.

Figure 1:
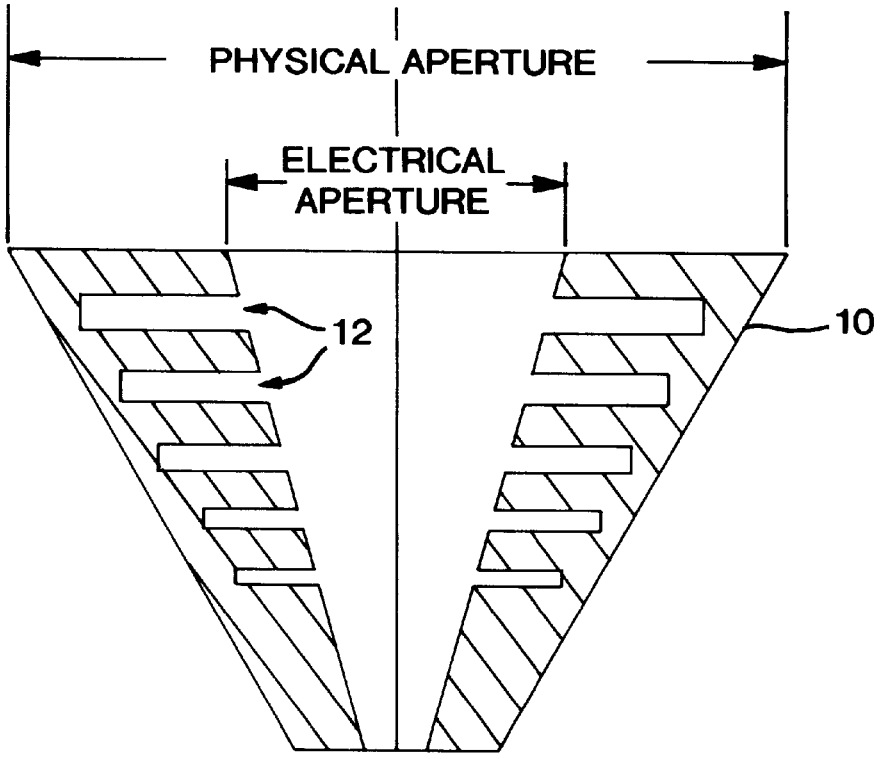
FIG. 1 PRIOR ART
FIG. 1 shows a corrugated horn studied by the inventors in developing the present invention.

Generally, the chokes will be substantially designed to have a depth equal to $\lambda/4$ for the center frequency that they are particularly tuned to. One advantage of using chokes, similar to the case of using corrugations such as described for FIG. 1, is that they serve to permit equalization of the E and H field plane patterns at each of the frequencies. On the other hand, if the horn is to be used as a feed for a reflector system, the actual beam widths for the patterns of the horn for each of the two frequencies should generally be different since the reflection system itself will reflect the patterns differently depending on the difference in frequencies. In other words, if the beam width from the horn is to be identical for both frequencies, it will be reflected such that the beam width for the higher frequency will be greater than the beam width for the lower frequency (assuming that the diameter of the reflecting surface will be the same for both frequencies). Therefore, in a reflector system, the beam width for the different frequency patterns from the horn should be set so that the ultimate patterns reflected from a primary reflector of the antenna system will have equal beam widths.

Unlike the corrugated horn arrangement shown in FIG. 1, the present invention has the significant advantage of providing an electrical aperture which is close in size to the physical aperture. As shown in FIG. 3, this can be the case because the axial direction of the depth of the chokes permits the electrical aperture to extend almost to the extreme physical edge of the horn. Essentially, the electrical aperture is defined by the inner diameter of the largest choke while the physical diameter can be defined by the outer diameter of the largest choke. Thus, only the wall thickness between the inner and outer diameters of the largest choke will define the difference between the electrical aperture and the physical aperture. Since the electrical aperture determines the antenna gain, this permits a significant increase in the antenna gain within the size constraints for which the antenna system is designed.

As an example of actual size, the embodiment shown in FIG. 3 can be constructed to have a maximum horn outer diameter (i.e., the physical aperture) of 3.6 inches while the electrical aperture of the outermost choke will be 3.4 inches. Therefore, the electrical aperture differs from the physical aperture only by 0.2 inches. Incidentally, with regard to the physical and electrical aperture size in terms of wavelength of the operating waves, the physical and electrical apertures in this particular case are about $6\lambda$ (based on $\lambda$=0.6 inches for the 20 GHz frequency). Generally, the apertures can be set between $\lambda$ and $10\lambda$, although this is not intended to be limiting.

Figure 4:
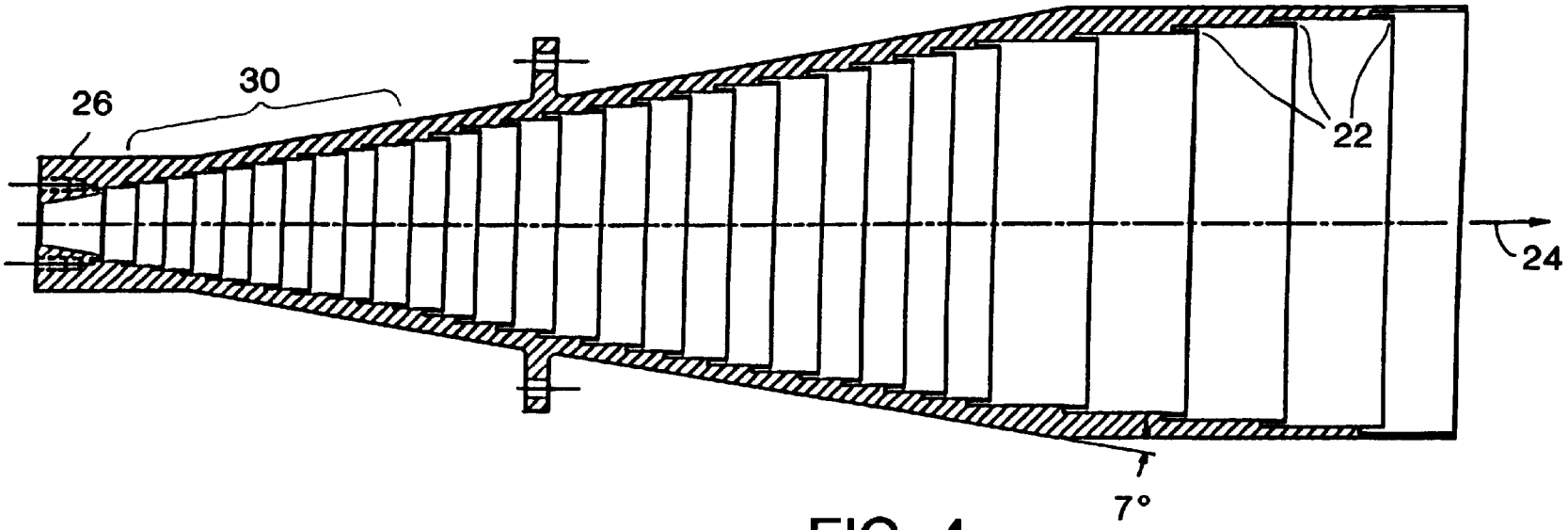
FIG. 4 is a sectional view taken from the line 4—4 of FIG. 2 showing details of a preferred embodiment of the present invention.

FIG. 4 is a cross-section of the horn shown in FIG. 1, illustrating a preferred embodiment of the present invention. In this embodiment, a total of 29 chokes 22 are provided for dual frequency operation at frequency bands 20 GHz and 30 GHz. In this arrangement, circular beams are created since the particular horn is designed for generation of circular beams between a satellite and a ground station. On the other hand, the present invention is not limited to conical, or circular beams, and could be used with other arrangements, for example, rectangular, or pyramidal, horns. Also, solely for purposes of example, it is noted that the horn shown in FIG. 1 can be extremely compact, having another diameter of 1.125 inches at the input of the coupling portion, a maximum outer diameter of 3.6 inches at the horn opening, and a total length of about 11.5 inches.

Preferably, the horns constructed in accordance with the present invention will be made with extremely light but strong material. For example, very thin nickel (for example, as thin as 0.005 inches) could be used in constructing the preferred embodiment shown in FIGS. 1 and 4. However, other materials could also be used, such as aluminum, if desired.

Figure 5:
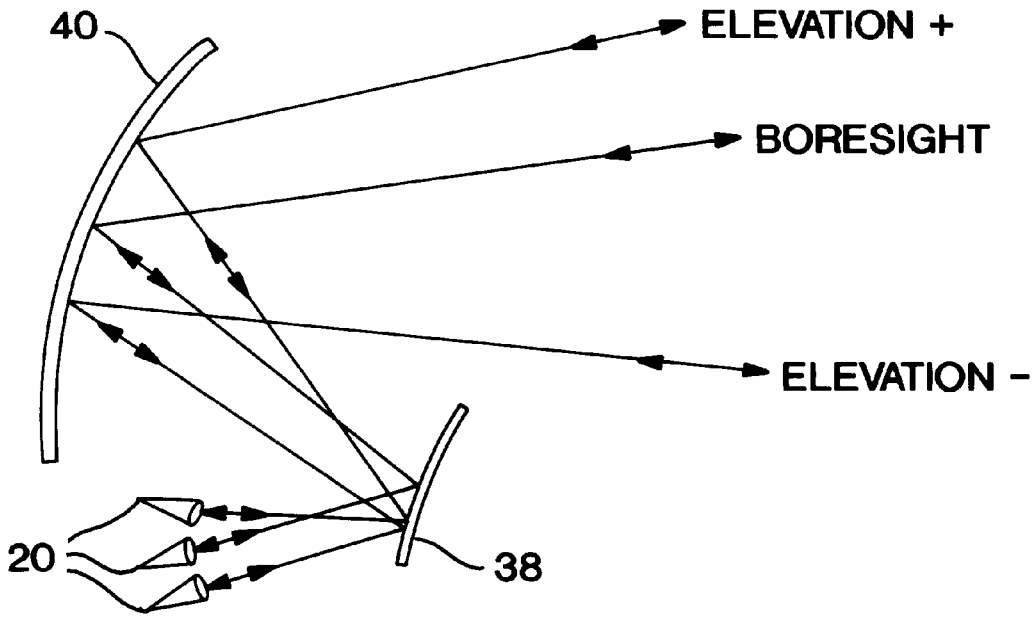
FIG. 5 is an illustration of a horn constructed in accordance with the present invention used in a satellite reflect antenna system.

FIG. 5 shows a satellite Cassegrain reflector system for a satellite antenna in which the present invention can be used. More specifically, a plurality of horns 20 of the present invention can be used with the sub-reflector 38 and the primary reflector 40 to generate a plurality of circular beams from the primary reflector 40 to separately cover different portions of the earth's surface. Generally, in the preferred Ka-Band system using 20 GHz for the uplink signal and 30 GHz for the downlink signal, this system will be designed to generate circularly symmetrical beams having a half power beam width of 9°. Of course, these dimensions are solely for purposes of example. Also, if rectangular, or pyramidal, horns were used, it is possible to generate non-circular beams to cover different shaped areas on the earth's surface.

Although the present invention is very useful as a feed horn for an antenna system in a satellite, it can be readily be used in other antenna systems as well, including, for example, ground stations or TVRO systems (i.e., television receive only systems). In addition, it is noted that the present invention can be used with a variety of reflector systems, including, but not limited to, offset, Cassegrain, front-fed, side-fed and Gregorian reflectors.

The above description sets forth a horn antenna that is capable of providing an electrical aperture which is nearly as large as the physical aperture, while, at the same time, providing operation at two or more frequencies with equalized E and H plane patterns for each of the frequencies. Another advantage of the present invention is that it is relatively easy to construct, in comparison with the relatively complicated structures previously used for obtaining dual frequency operation, and, due to the minimum number of parts required, is relatively maintenance free. This, of course, is particularly important in satellite antenna design where maintenance is quite difficult.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

We claim:

1. A horn antenna for operating in a plurality of separate frequency bands comprising:

a coupling portion to permit coupling of the horn antenna to a communication device;

an inner portion coupled to the coupling portion, including a plurality of first chokes operating in a first frequency band, wherein depths of the first chokes extends substantially parallel to a central longitudinal axis of the antenna and widths of the first chokes extend in a radial direction of the antenna; and an outer portion coupled to the inner portion and having a maximum diameter in the radial direction which is greater than a maximum diameter in the radial direction of the inner portion, the outer portion comprising a plurality of second chokes operating in a second frequency band different than the first frequency band having depths which extend substantially parallel to the central longitudinal axis of the antenna and widths which extend in the radial direction, wherein the depths and the widths of the second chokes are greater than the depths and the widths of the first choke.

2. A horn antenna according to claim 1, wherein the first frequency band is higher in frequency band than the second frequency.

3. A horn antenna according to claim 2, wherein the first frequency band includes 30 GHz and the second frequency includes 20 GHz.

4. A horn antenna according to claim 1, further comprising at least one middle portion coupled between the outer portion and the inner portion, said middle portion including a plurality of third chokes having depths which extend substantially parallel to the central longitudinal axis of the antenna and widths which extend in the radial direction, wherein the depths and the widths of the third chokes are greater than the depths and the widths of the first chokes but less than the depths and the widths of the second chokes, and wherein the depths and the widths of the third chokes are set so that said third chokes operate in a third frequency band which is separate from the first and second frequency bands.

5. A horn antenna according to claim 4, wherein the third frequency band is lower in frequency than the first frequency band but higher in frequency than the second frequency band.

6. A horn antenna according to claim 1, wherein the plurality of the first chokes are provided to extend between the coupling portion and the outer portion, and wherein the first choke closest to the coupling portion has a first depth, wherein the first choke furthest from the coupling portion has a second depth, greater than the first depth, and wherein the depths of the other first chokes located between the first choke closest to the coupling portion and the first choke farthest from the coupling portion gradually increase in depth to provide gradually decreasing center frequencies within the first frequency band.

7. A horn antenna according to claim 6, wherein the first choke closest to the coupling portion has a first width, wherein the first choke portion furthest from the coupling portion has a second width, greater than the first width, and wherein the widths of the other first chokes located between the first choke closest to the coupling portion and the first choke farthest from the coupling portion gradually increase in width.

8. A horn antenna according to claim 7, wherein the plurality of the second chokes are provided in the outer portion to extend away from the inner portion, and wherein the second choke closest to the inner portion has a first depth, wherein the second choke farthest from the inner portion has a second depth, greater than the first depth, and wherein the depths of the other second chokes located between the second choke closest to the inner portion and the second choke farthest from the inner portion gradually increase in depth to provide gradually decreasing center frequencies within the second frequency band.

9. A horn antenna according to claim 8, wherein the second choke closest to the inner portion has a first width, wherein the second choke farthest from the inner portion has a second width, greater than the first width, and wherein the widths of the other second chokes located between the second choke closest to the inner portion and the second choke farthest from the inner portion gradually increase in width.

10. A horn antenna according to claim 9, wherein the horn is circular.

11. A horn antenna according to claim 9, wherein the depths of the first chokes are substantially equal to $\lambda/4$ for the frequencies which the first chokes are respectively tuned for, and wherein the depths for the second chokes are equal substantially equal $\lambda/4$ for the frequencies which the second chokes are respectively tuned for.

12. A horn antenna according to claim 6, wherein the plurality of the second chokes are provided in the outer portion to extend away from the inner portion, and wherein the second choke closest to the inner portion has a first depth, wherein the second choke farthest from the inner portion has a second depth, greater than the first depth, and wherein the depths of the other second chokes located between the second choke closest to the inner portion and the second choke farthest from the inner portion gradually increase in depth to provide gradually decreasing center frequencies within the second frequency band.

13. A horn antenna according to claim 12, wherein each of the first chokes is tuned to have a different center frequency within the first frequency band and a predetermined bandwidth so that the plurality of first chokes combine to provide substantially continuous coverage of the first frequency band, and wherein each of said second chokes is tuned to have a different center frequency within the second frequency band and a predetermined bandwidth so that the plurality of second chokes combine to provide substantially continuous coverage of the second frequency band.

14. A horn antenna according to claim 13, wherein the first frequency band is higher in frequency than the second frequency band, and wherein the frequency difference between the lowest frequency of the first frequency band and the highest frequency of the second frequency band is greater than the frequency difference between the upper and lower frequencies of the first frequency band or the second frequency band.

15. A horn antenna according to claim 6, wherein the depths of the first chokes are each substantially equal to $\lambda/4$ for the respective center frequencies which each of the first chokes are tuned for.

16. A horn antenna according to claim 1, wherein the plurality of the second chokes are provided in the outer portion to extend away from the inner portion, and wherein the second choke closest to the inner portion has a first depth, wherein the second choke farthest from the inner portion has a second depth, greater than the first depth, and wherein the depths of the other second chokes located between the second choke closest to the inner portion and the second choke farthest from the inner portion gradually increase in depth to provide gradually decreasing center frequencies within the second frequency band.

17. A horn antenna according to claim 16, wherein the second choke closest to the inner portion has a first width, wherein the second choke farthest from the inner portion has a second width, greater than the first width, and wherein the widths of the other second chokes located between the second choke closest to the inner portion and the second choke farthest from the inner portion gradually increase in width.

18. A horn antenna according to claim 17, wherein the depths of the second chokes are substantially equal to $\lambda/4$ for the respective center frequencies which each of the second chokes are respectively tuned for.

19. A horn antenna according to claim 16, wherein the second choke closest to the inner portion has a first width, wherein the second choke farthest from the inner portion has a second width, greater than the first width, and wherein the widths of the other second chokes located between the second choke closest to the inner portion and the second choke farthest from the inner portion gradually increase in width.

20. A horn antenna according to claim 1, wherein the horn is circular.

21. A horn antenna according to claim 1, wherein the depths of the first chokes are substantially equal to $\lambda/4$ for the first frequency, and wherein the depths for the second chokes are substantially equal to $\lambda/4$ for the second frequency.

22. A horn antenna according to claim 1, wherein said horn antenna is a feed horn for a reflector antenna system.

23. A horn antenna according to claim 1, wherein the depths and widths of the first chokes substantially equalize the E and H plane patterns of the horn antenna for the first frequency band, and wherein the depths and widths of the second chokes substantially equalize the E and H plane patterns of the horn antenna for the second frequency band.

24. A horn antenna according to claim 23, wherein the first antenna pattern is a transmitting antenna pattern, and wherein the second antenna pattern is a receiving antenna pattern.

25. A horn antenna according to claim 24, wherein said horn antenna is a satellite feed antenna for a satellite reflector antenna system.

26. A horn antenna according to claim 25, wherein the first frequency band is a downlink frequency band for the satellite and the second frequency band is an uplink frequency band for the satellite.

27. A horn antenna according to claim 26, wherein the first and second frequency bands are both in the Ka frequency band.

28. A horn antenna according to claim 1, wherein a frequency difference between the first and second frequency bands is substantially greater than frequency differences between a maximum frequency and a minimum frequency within each of the first and second frequency bands.

29. A horn antenna according to claim 1, wherein each of the first chokes operates at a different frequency within the first frequency band, wherein each of the second chokes operates a different frequency within the second frequency band, and wherein a frequency difference between the first and second frequency bands is substantially greater than frequency differences between the maximum and minimum frequencies within each of the first and second frequency bands.

30. A horn antenna according to claim 1, wherein the first frequency band is between 29.99 GHz to 30.01 GHz and the second frequency band is between 19.99 GHz to 20.01 GHz.

31. A horn antenna for operating in a first frequency band and a second frequency band different from the first frequency band, and for providing equalized E and H plane patterns for the first frequency band and equalized E and H plane patterns for the second frequency band, comprising:

a plurality of first chokes operating in the first frequency band having depths extending in a direction parallel to a center longitudinal axis of the antenna and widths extending in a radial direction; and a plurality of second chokes operating in the second frequency band having depths extending in a direction parallel to the central longitudinal axis of the antenna and widths extending in a radial direction, wherein the maximum diameter of the horn at the location of the second chokes is greater than the maximum diameter of the horn at the location of the first chokes, wherein the second frequency band is lower than the first frequency band and wherein the depths and widths of the first and second chokes are respectively provide substantially equalized E and H plane patterns for the first frequency band and substantially equalized E and H plane patterns for the second frequency band.

32. A horn antenna according to claim 31, wherein the maximum electrical aperture of the horn is substantially equal to the outer diameter of the horn at the second choke, and wherein the maximum electrical aperture of the horn antenna is substantially equal to the maximum physical diameter of the horn antenna.

33. A horn antenna according to claim 32, wherein said horn antenna is a feed antenna for a satellite reflector antenna.

34. A horn antenna according to claim 33, wherein the first frequency band is a downlink frequency band for the satellite, and wherein the second frequency band is an uplink frequency band for the satellite.

35. A horn antenna according to claim 34, wherein the first frequency band includes 30 GHz and the second frequency band includes 20 GHz.

36. A horn antenna according to claim 31, wherein each of the first chokes has a different depth and a different width from the other first chokes, and wherein each of the second chokes has a different depth and a different width from the other second chokes.

37. A horn antenna according to claim 31, wherein a frequency difference between the first and second frequency bands is substantially greater than frequency differences between a maximum frequency and a minimum frequency within each of the first and second frequency bands.

38. A horn antenna according to claim 31, wherein each of the first chokes operates at a different frequency within the first frequency band, wherein each of the second chokes operates a different frequency within the second frequency band, and wherein a frequency difference between the first and second frequency bands is substantially greater than frequency differences between the maximum and minimum frequencies within each of the first and second frequency bands.

39. A horn antenna according to claim 31, wherein the first frequency band is between 29.99 GHz to 30.01 GHz and the second frequency band is between 19.99 GHz to 20.01 GHz.

40. A horn antenna for operating in at least first and second frequency bands which are separate from one another and for providing substantially equalized E and H plane patterns for the first and second frequency bands, comprising:

means for providing electromagnetic waves in the first and second frequency bands to the horn antenna, wherein the first frequency band is higher in frequency than the second frequency band;

an inner portion, having a minimum diameter and a maximum diameter, for operating in the first frequency band, comprising a plurality of first chokes coupled to one another to extend between the minimum diameter and the maximum diameter, wherein the depths of the first chokes extend substantially parallel to a central longitudinal axis of the antenna and the widths of the first chokes extend in a radial direction of the antenna, wherein the depths and the widths of the first chokes increase for each of the first chokes between the minimum diameter and the maximum diameter to provide different center frequencies for each of the first chokes within the first frequency band; and an outer portion, having a minimum diameter and a maximum diameter, for operating in the second frequency band, wherein the point of minimum diameter for the outer portion is coupled to the point of maximum diameter for the inner portion, said outer portion comprising a plurality of second chokes coupled to one another between the minimum diameter of the outer portion and the maximum diameter of the outer portion, wherein the second chokes have depths which extend substantially parallel to the central longitudinal axis of the antenna and widths which extend in the radial direction, wherein the depths and the widths of the second choke are greater than the depths and the widths of the first chokes, and wherein the depths and the widths of the second chokes increase for each of the second chokes between the minimum diameter and the outer diameter of the outer portion to provide different center frequencies for each of the second chokes within the second frequency band, wherein the depths and the widths of the first and second chokes provide substantially equalized E and H plane patterns for the first frequency band and substantially equalized E and H plane patterns for the second frequency band.

41. A horn antenna according to claim 40, wherein said horn antenna is a feed antenna for a satellite reflector antenna.

42. A horn antenna according to claim 40, wherein the first frequency band is a downlink frequency band for the satellite, and wherein the second frequency band is an uplink frequency band for the satellite.

43. A horn antenna according to claim 42, wherein the first frequency band includes 30 GHz and the second frequency band includes 20 GHz.

44. A horn antenna according to claim 40, wherein a frequency difference between the first and second frequency bands is substantially greater than frequency differences between a maximum frequency and a minimum frequency within each of the first and second frequency bands.

45. A horn antenna according to claim 40, wherein each of the first chokes operates at a different frequency within the first frequency band, wherein each of the second chokes operates a different frequency within the second frequency band, and wherein a frequency difference between the first and second frequency bands is substantially greater than frequency differences between the maximum and minimum frequencies within each of the first and second frequency bands.

46. A horn antenna according to claim 40, wherein the first frequency band is between 29.99 GHz to 30.01 GHz and the second frequency band is between 19.99 GHz to 20.01 GHz.

* * * * *